US007516705B2

(12) United States Patent
Hedstrom

(10) Patent No.: US 7,516,705 B2
(45) **Date of Patent: *Apr. 14, 2009**

(54) PALLET WITH STRENGTH PLATES AND RELATED METHODS

(75) Inventor: Kristen Karl Hedstrom, Orlando, FL (US)

(73) Assignee: Chep Technology Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/839,825

(22) Filed: Aug. 16, 2007

(65) Prior Publication Data

US 2008/0028998 A1 Feb. 7, 2008

Related U.S. Application Data

(63) Continuation-in-part of application No. 11/678,806, filed on Feb. 26, 2007.

(60) Provisional application No. 60/777,434, filed on Feb. 28, 2006, provisional application No. 60/828,522, filed on Oct. 6, 2006.

(51) Int. Cl.
*B65D 19/16* (2006.01)

(52) U.S. Cl. ..... 108/56.3; 108/57.17

(58) Field of Classification Search ..... 108/51.11, 108/56.1, 56.3, 57.17, 57.21, 57.33, 901; 206/386, 595, 596, 598, 599, 600

See application file for complete search history.

(56) References Cited

U.S. PATENT DOCUMENTS

| | | | | |
|---|---|---|---|---|
| 2,503,022 A | * | 4/1950 | Benoist et al. | 108/57.17 |
| 2,919,090 A | | 12/1959 | De Pew | 248/120 |
| 2,967,036 A | | 1/1961 | Phillips | 248/120 |
| 3,126,843 A | | 3/1964 | De Laney | 108/52 |
| 3,207,096 A | * | 9/1965 | Munroe | 108/51.11 |
| 3,472,182 A | * | 10/1969 | Eklund | 108/57.17 |
| 3,910,203 A | | 10/1975 | Hamkins et al. | 108/51 |
| 4,159,681 A | | 7/1979 | Vandament | 108/51.1 |
| 4,220,099 A | | 9/1980 | Marchesano | 108/51.1 |
| 4,240,358 A | | 12/1980 | Munroe | 108/51.1 |
| 4,715,294 A | | 12/1987 | Depew | 108/51.1 |

(Continued)

FOREIGN PATENT DOCUMENTS

EP 775638 * 11/1995

*Primary Examiner*—Janet M Wilkens
(74) *Attorney, Agent, or Firm*—Allen, Dyer, Doppelt, Milbrath & Gilchrist, P.A.

(57) ABSTRACT

A pallet includes a cargo layer and a base layer. The base layer includes a pair of spaced apart end deck boards, and a pair of spaced apart connector boards orthogonal to the pair of spaced apart end deck boards, with each connector board and each end deck board having respective ends. A strength plate is coupled to each respective end of the connector boards in the base layer. Spaced apart support blocks are between the base and cargo layers, and form a gap therebetween for receiving a lifting member. First fasteners couple the cargo layer to an upper surface of the support blocks. Second fasteners couple the base layer to a lower surface of the support blocks so that the ends of the connector boards and the corresponding strength plates are coupled to a first area of the lower surface of the support blocks, and so that the ends of the end deck boards are coupled to a second area of the lower surface of the support blocks.

24 Claims, 6 Drawing Sheets

U.S. PATENT DOCUMENTS

| | | | | | |
|---|---|---|---|---|---|
| D306,226 | S | | 2/1990 | Jirucha | D34/38 |
| 5,076,175 | A | | 12/1991 | Whatlet, II | 108/51.1 |
| 5,351,628 | A | * | 10/1994 | Breezer et al. | 108/56.1 |
| 5,673,629 | A | | 10/1997 | Ginnow | 108/51.1 |
| D390,317 | S | | 2/1998 | Fenton | D34/38 |
| 5,809,902 | A | | 9/1998 | Zetterberg | 108/51.1 |
| 5,887,529 | A | * | 3/1999 | John et al. | 108/56.1 |
| 5,960,721 | A | | 10/1999 | Huetteman et al. | 108/57.17 |
| 6,003,448 | A | | 12/1999 | Skuse | 108/51.11 |
| 6,584,915 | B1 | * | 7/2003 | Rogers | 108/56.1 |
| 7,021,879 | B2 | * | 4/2006 | Taneichi | 411/466 |
| 2006/0005746 | A1 | | 1/2006 | Gouldin, Jr. | 108/51.11 |

* cited by examiner

PALLET WITH STRENGTH PLATES AND RELATED METHODS

RELATED APPLICATIONS

This application is a continuation-in-part of U.S. patent application Ser. No. 11/678,806 filed Feb. 26, 2007 which claims the benefit of U.S. Provisional Application Ser. Nos. 60/777,434 filed Feb. 28, 2006 and 60/828,522 filed Oct. 6, 2006, the entire contents of which are incorporated herein by reference.

FIELD OF THE INVENTION

The present invention relates to the field of pallets, and more particularly, to a pallet having an improved resilience to impacts from material handling equipment, and to related methods for making the same.

BACKGROUND OF THE INVENTION

Conventional pallets include a base layer and a cargo layer separated therefrom by support blocks. Traditionally, the base and cargo layers respectively have end deck boards of a common thickness assembled on connector boards that run the full length or width of the pallet. The end deck boards are nailed through the connector boards into the support blocks to build the primary structure of the pallet. Intermediate deck boards are placed between the end deck boards. The end deck boards are also known as lead boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

In an effort to improve pallet durability, an intermediate deck board may butt up against an end deck board to help resist impacts from material handling equipment. While this technique is effective at generating more resistance, the effect of a failure is often two boards being broken instead of just one.

Another approach is disclosed in U.S. Pat. No. 4,220,099 to Marchesano. The '099 patent discloses a pallet comprising at least two runners, and a plurality of deck boards or stringers coupled to the runners. In particular, the end deck boards in the cargo layer are dadoed or undercut into the runners to thereby strengthen the pallet. The end deck boards in the base layer are received in recessed portions of the runners so that they butt up against the runners. This may be effective in strengthening the pallet, but undercutting the end deck boards for the cargo layer and the corresponding runners is a time consuming process, and as a result, adds to the expense of building a pallet.

The use of nail plates to strengthen wood pallet joints is disclosed in U.S. Pat. No. 7,056,074 to Bas. The nail plates are placed between an upper surface of the support blocks and boards in the cargo layer, and between a lower surface of the support blocks and boards in the base layer. Each nail plate includes projections extending from upper and lower surfaces thereof, and a center opening for receiving a connecting device. A respective connecting device is used for each support block to couple the corresponding boards in the cargo and base layers to each support block, with the corresponding nail plates penetrating into opposing wood surfaces. This may also be effective in strengthening the pallet, but positioning the nail plates so that the center openings are aligned for receiving the connecting devices is critical, and as a result, adds to the expense of building a pallet.

SUMMARY OF THE INVENTION

In view of the foregoing background, it is therefore an object of the present invention to provide a pallet having an improved resilience to impacts from material handling equipment without increasing the cost as compared to conventional block pallets.

This and other objects, features, and advantages in accordance with the present invention are provided by a pallet comprising a cargo layer and a base layer. The base layer may comprise a pair of spaced apart end deck boards, and a pair of spaced apart connector boards orthogonal to the pair of spaced apart end deck boards, with each connector board and each end deck board having respective ends. To improve the resiliency of the pallet to impacts, a strength plate may be coupled to each respective end of the connector boards in the base layer.

A plurality of spaced apart support blocks may be between the base and cargo layers, thus forming a gap therebetween for receiving a lifting member from material handling equipment. A first plurality of fasteners may couple the cargo layer to an upper surface of the plurality of support blocks. A second plurality of fasteners may couple the base layer to a lower surface of the plurality of support blocks. The ends of the connector boards and the corresponding strength plates may be coupled to a first area of the lower surface of the support blocks, and the ends of the end deck boards may be coupled to a second area of the lower surface of the support blocks. The first and second areas of the lower surface of the support blocks may be coplanar.

The strength plate advantageously strengthens the ends of the connector boards in the base layer. As is typically the case, the ends of the connector boards in the base layer are the weak link in the pallet, and they start to separate when the end deck boards in the base layer receive a fairly large impact force. Without the strength plates, the impact force is transferred from the end deck boards to the fasteners in the ends of the connector boards. However, with the strength plates, the impact force is transferred from the end deck boards to the strength plates adjacent the fasteners in the ends of the connector boards. The strength plates thus reduce separation of the ends of the connector boards, which in turn helps to increase the service life of the pallet.

Each strength plate may comprise projections extending therefrom for penetrating into a respective end of the connector boards in the base layer. Each strength plate includes a lower surface from which the projections extend therefrom, and an upper surface that may be devoid of any projections. In addition, each strength plate may have a width that is substantially equal to a width of a respective end of the connector boards in the base layer.

The cargo layer may also comprise a pair of spaced apart end deck boards, and a pair of spaced apart connector boards orthogonal to the pair of spaced apart end deck boards, with each connector board and each end deck board having respective ends. The upper surface of each support block may be stepped and comprise a first area for receiving the end of an end deck board, and a second area for receiving the end of a connector board. An advantage of the stepped top surface of the support blocks is that when an impact force is applied to an end deck board, it also helps to improve the resiliency to impacts from material handling equipment as compared to a conventional block pallet. Alternatively, the upper surface of the support blocks may be coplanar as in the lower surface of the support locks.

Another aspect of the invention is directed to a method for making a pallet comprising providing cargo and base layers, with the base layer comprising a pair of spaced apart end deck boards, and a pair of spaced apart connector boards orthogonal to the pair of spaced apart end deck boards, with each connector board and each end deck board having respective ends.

The method may further comprise coupling a strength plate to each respective end of the connector boards in the base layer, and providing spaced apart support blocks between the base and cargo layers. The support blocks form a gap between the cargo and base layers for receiving a lifting member. First fasteners may be used for coupling the cargo layer to an upper surface of the support blocks. Second fasteners may be used for coupling the base layer to a lower surface of the support blocks. The ends of the connector boards and the corresponding strength plates may be coupled to a first area of the lower surface of the support blocks, and the ends of the end deck boards may be coupled to a second area of the lower surface of the support blocks.

DETAILED DESCRIPTION OF THE PREFERRED EMBODIMENTS

Figure 1:
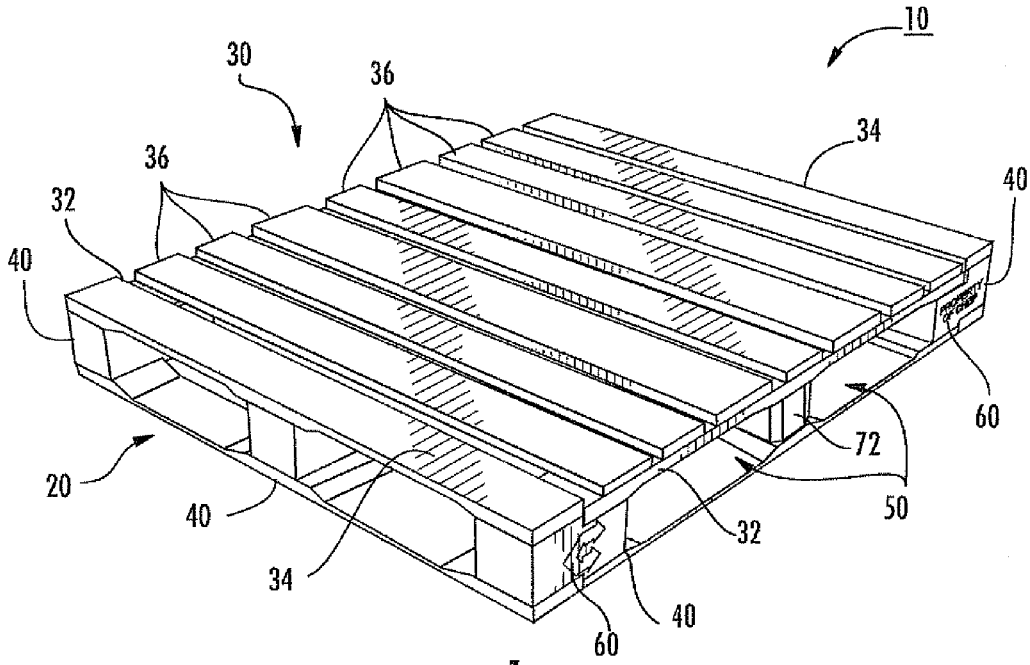
FIG. 1 is a top perspective view of a pallet in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Referring initially to FIGS. 1-4, the pallet 10 in accordance with the invention comprises a base layer 20, a cargo layer 30 and a plurality of "stepped" support blocks 40. The support blocks 40 are coupled between the base and cargo layers 20, 30 and define a space 50 therebetween for receiving at least one lifting member of material handling equipment, such as a fork lift tine.

The pallet 10 is preferably made out of wood. However, other types of materials or composites may be used to form the pallet, as readily appreciated by those skilled in the art. These other materials and composites may or may not include wood. For purposes of discussion, the illustrated pallet 10 is made out of wood.

As will be discussed in greater detail below, the upper surface of the support blocks has multiple levels so that boards from the cargo layer 30 are coupled at different levels to the support blocks. This configuration of the support blocks is known as single stepped support blocks. Likewise, the lower surface of the support blocks may have multiple levels so that boards from the base layer 20 are coupled at different levels to the support blocks. This configuration of the support blocks is known double stepped support blocks. The single and double stepped support blocks advantageously improve the resiliency of the pallet 10 to withstand impacts from material handling equipment.

The cargo layer 30 comprises a pair of spaced apart connector boards 32, and a pair of spaced apart end deck boards 34 orthogonal to the connector boards so that the cargo layer has a rectangular shape. Each support block 40 comprises a stepped top surface including a first level 48*a* for receiving an end deck board 34, and a second level 48*b* for receiving a connector board 32. In addition to the pair of connector boards 32, additional support blocks 40 are positioned along the end deck boards 34 so that at least one more connector board 32 extends parallel to the pair of connector boards.

The stepped top surface of each support block 40 is configured so that the first level 48*a* is above the second level 48*b* with a transition wall 49 defined therebetween. As a result, an end of each connector board 32 is adjacent the transition wall 49 in the support block 40 coupled thereto. For manufacturing and assembly purposes, there is normally a tolerance gap between the transition wall 49 and the end of the corresponding connector board 32. However, the end deck boards 34 are normally positioned so that they butt up against ends of the connector boards 32.

When an impact force is applied to an end deck board 34, the force is transmitted to the ends of the connector boards 32 so that the energy of the impact is dissipated over the length of the pallet. More specifically, the end grain of the connector boards 32 absorb the impact force instead of the nail joints used to secure the end deck boards 34 to the support blocks 40. The stepped top surface thus improves the resiliency to impacts from material handling equipment as compared to a conventional block pallet.

The cargo layer 30 further comprises spaced apart intermediate deck boards 36 coupled to the connector boards 32. The intermediate deck boards 36 are substantially parallel to the end deck boards 34. An outer exposed top surface of the intermediate deck boards 36 is coplanar with outer exposed top surfaces of the end deck boards 34.

Another advantage of the stepped top surface of the support blocks 40 is that the thickness of the end deck boards 34 is independent of the thickness of the intermediate deck boards 36. This advantageously allows for thinner intermediate deck boards 36. The overall result is a lower cost pallet 10 that is more durable than a conventional block pallet.

Figure 5:
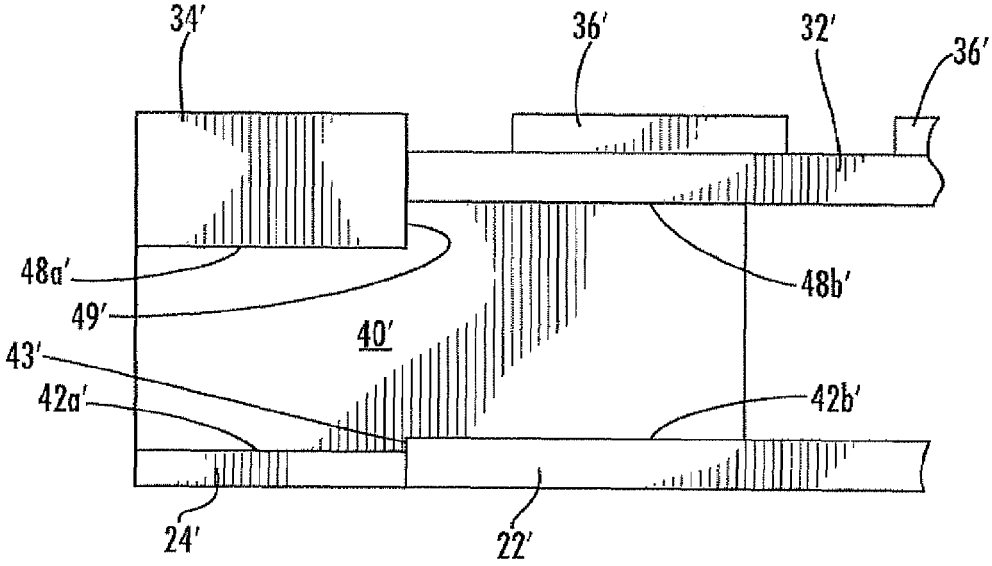
FIG. 5 is a side view of another embodiment of the support block in accordance with the present invention.

In an alternate embodiment, the stepped top surface of each support block 40' may be configured so that the first level 48*a*' is below the second level 48*b*' with a transition wall 49' defined therebetween, as shown in FIG. 5. This time, however, one side of each end deck board 34' is adjacent the transition wall 49' in the support blocks 40' coupled thereto.

Still referring to FIGS. 1-4, the base layer 20 comprises a pair of spaced apart end deck boards 24, and a pair of spaced apart connector boards 22 orthogonal to the end deck boards so that the base layer has a rectangular shape. Each support block 40 further comprises a stepped bottom surface including a first level 42*a* for receiving an end deck board 24 from the base layer, and a second level 42*b* for receiving a connector board 22 from the base layer.

The stepped top and bottom surfaces for each support block 40 thus defines a double stepped support block. The double stepped support block 40 advantageously improves the resiliency of the pallet 10 to withstand impacts from material handling equipment.

Figure 4:
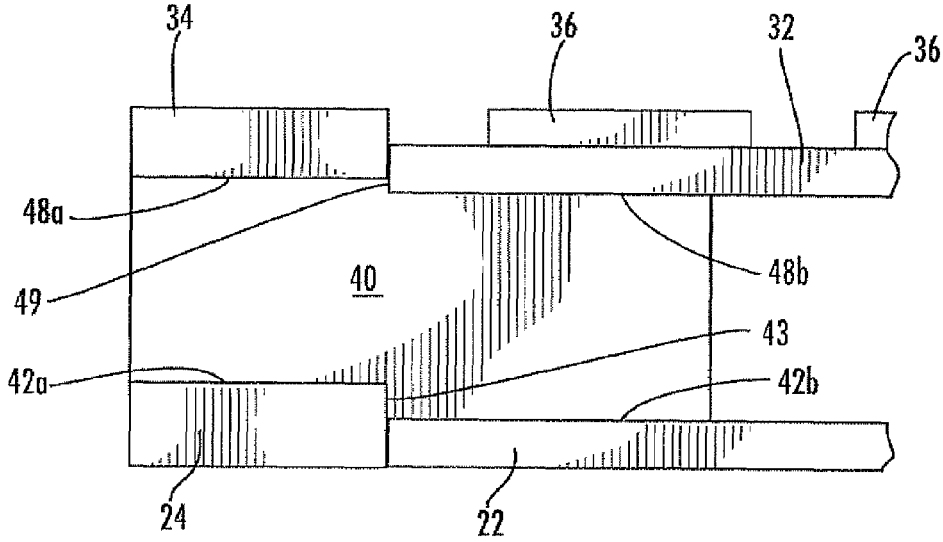
FIG. 4 is a side view of a support block shown in FIG. 1 with the end deck boards, the connector boards and the intermediate deck boards coupled thereto.

An outer exposed bottom surface of each connector board 22 and an outer exposed bottom surface of each end deck board 24 from the base layer 20 are coplanar. As best shown in FIG. 4, the stepped bottom surface of each support block 40 is configured so that the first level 42*a* is above the second level 42*b* with a transition wall 43 defined therebetween. As a result, one side of each end deck board 24 from the base layer 20 is adjacent the transition wall 43 in the support blocks 40 coupled thereto.

In an alternate embodiment, the stepped bottom surface of each support block 40' may be configured so that the first level 42*a*' is below the second level 42*b*' with a transition wall 43' defined therebetween, as shown in FIG. 5. This time, however, an end of each connector board 22' is adjacent the transition wall 43' in the support block 40' coupled thereto.

Figure 6:
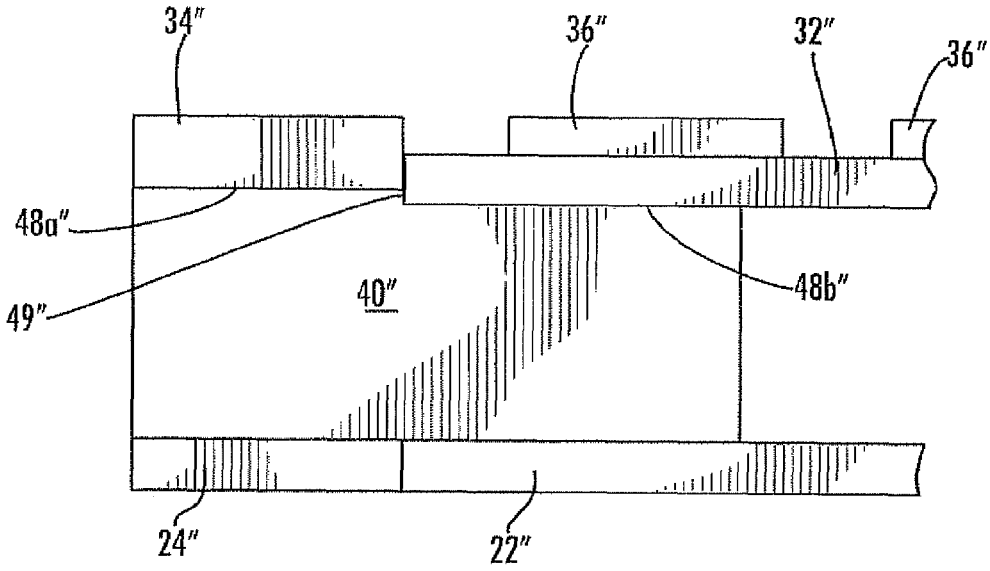
FIG. 6 is a side view of yet another embodiment of the support block in accordance with the present invention.

In yet another embodiment, the bottom surface of each support block 40" may be coplanar, as shown in FIG. 6. The end deck boards 24" and the connector boards 22" in the base layer 20" have the same thickness. In addition, the connector board 22" may butt up against the end deck board 24" in the base layer 20". In this embodiment, the end deck boards 24" and the connector boards 22" in the base layer 20" have the same thickness. This embodiment defines a single stepped support block 40". Even with a single stepped support block 40, the resiliency of the pallet 10 to withstand impacts from material handling equipment is advantageously improved as compared to a conventional block pallet.

The different levels of the first and second levels in the top surface of the support blocks, and the different levels of the first and second levels in the bottom surface of the supports blocks may be mixed and matched for a configuration not shown in the drawings. For example, the first level 48*a*' is below the second level 48*b*' in the top stepped surface of the support block as shown in FIG. 5, but the first level 42*a* may be above the second level 42*b* as shown in FIG. 4.

Figure 7:
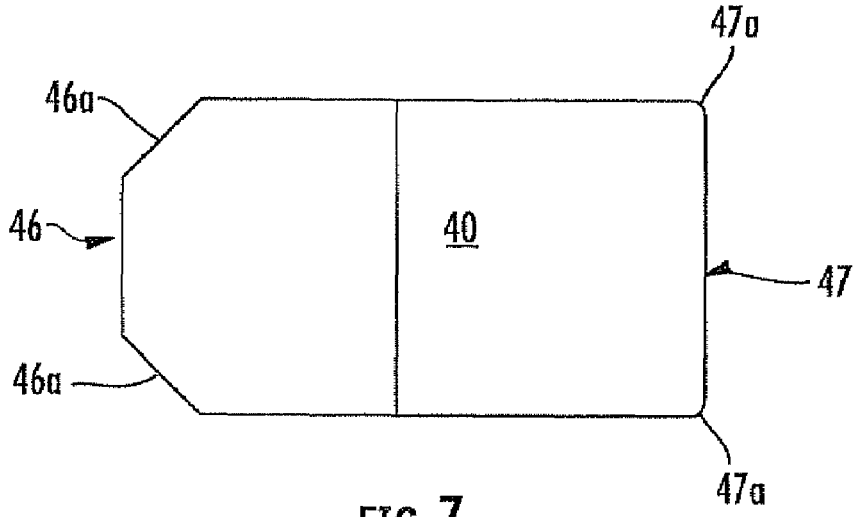
FIG. 7 is a top view of the support block in accordance with the present invention.

The edges of each support block 40 extending between the base layer 20 and the cargo layer 30 may be curved and/or angled, as best shown by the top view of the support block in FIG. 7. The inner face 46 of the support block 40 is inserted into the opening 50 of the pallet 10, and includes angled edges 46*a*. The angled edges 46*a* may be within a range of about 25 to 75 degrees, for example, to deflect the impact force of the forklift tines should such an impact occur. The illustrated edges are angled at 45 degrees.

Figure 2:
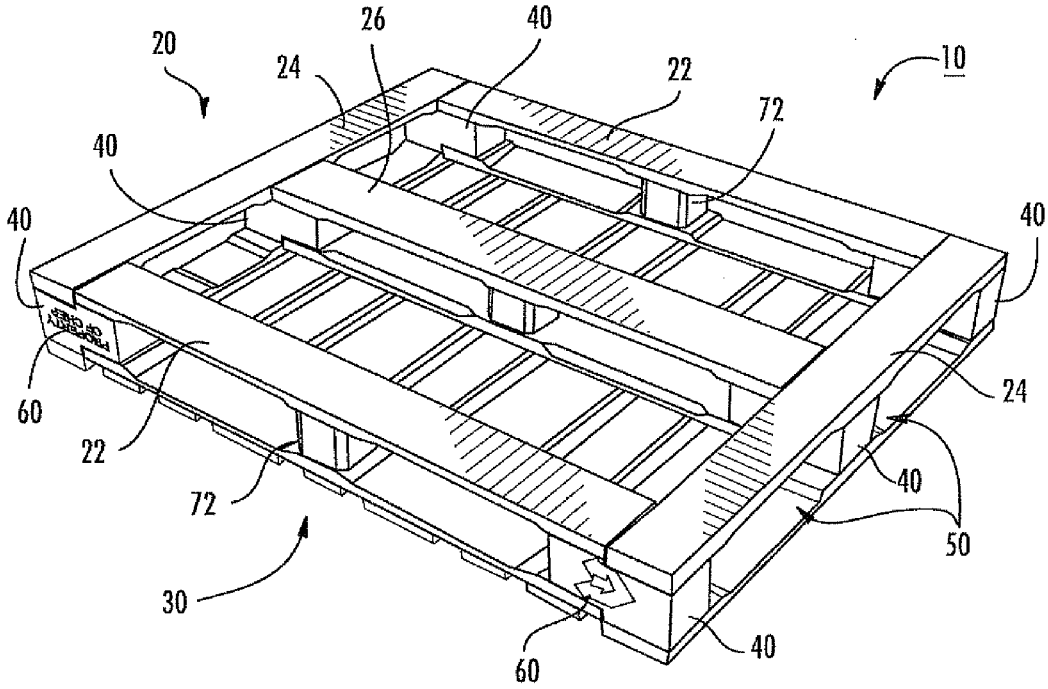
FIG. 2 is a bottom perspective view of the pallet shown in FIG. 1.
Figure 3:
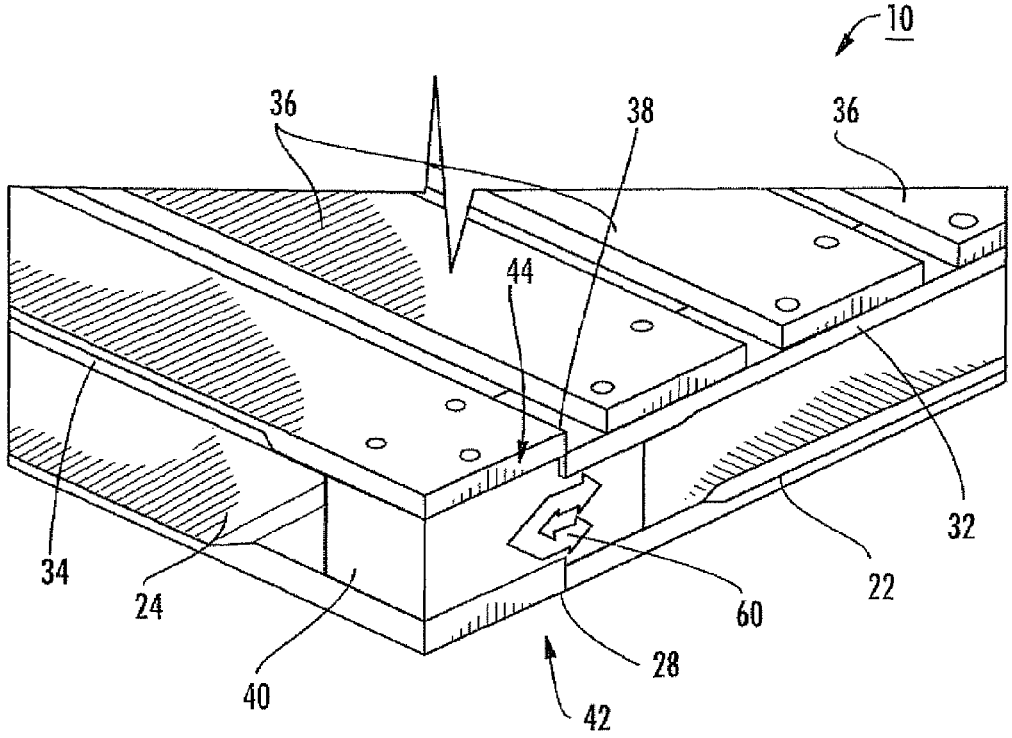
FIG. 3 is an enlarged perspective view of a corner of the pallet shown in FIG. 1.

The outer face 47 of the support block 40 faces away from the opening 50 of the pallet 10, and includes angled edges 47*a*. The angled edges have a curved radius within a range of about 2 to 12 mm, for example, and preferably within a range of about 4 to 8 mm. Indicia 60 may also be placed on the outer facing sidewalls of the support blocks 40, as shown in FIGS. 1-3. Alternatively, the edges of the support blocks 40 may all be angled or they may all be curved. Of course, the adjacent surfaces of the support block 40 defining an edge could be orthogonal to one another so that the edges are neither curved nor angled. Instead, the edges are pointed.

The pallet 10 further comprises a plurality of intermediate support blocks 72 coupled between the base layer 20 and the cargo layer 32. Each intermediate support block 72 has coplanar top and bottom surfaces for receiving the respective connector boards 22, 32 from the base and cargo layers 20, 30.

Figure 8:
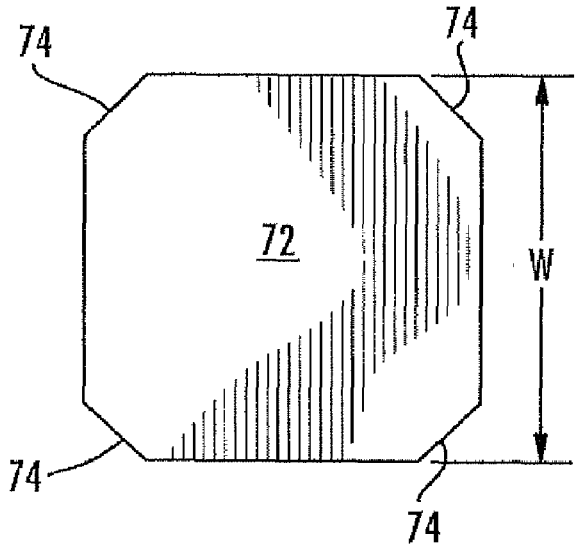
FIG. 8 is a top view of an intermediate support block in accordance with the present invention.

The intermediate support blocks 72 are rectangular shaped, as best shown by the top view in FIG. 8. The width w of each intermediate support block 72 is preferably the same width as the connector boards 22, 32 in the base and cargo layers 20, 30. The edges 74 of the intermediate support block 72 may be similar to the edges of the support blocks 40. As shown in FIG. 8, the edges are angled at 45 degrees, for example.

Figure 9:
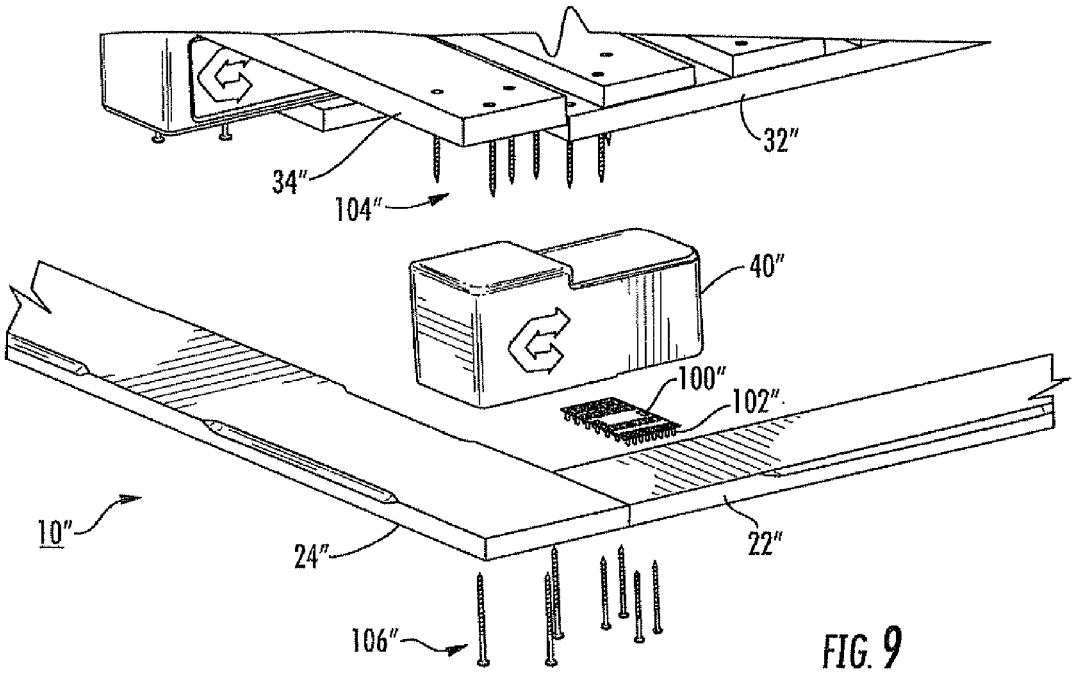
FIG. 9 is an exploded corner perspective view of a pallet with a strength plate in accordance with the present invention.
Figure 10:
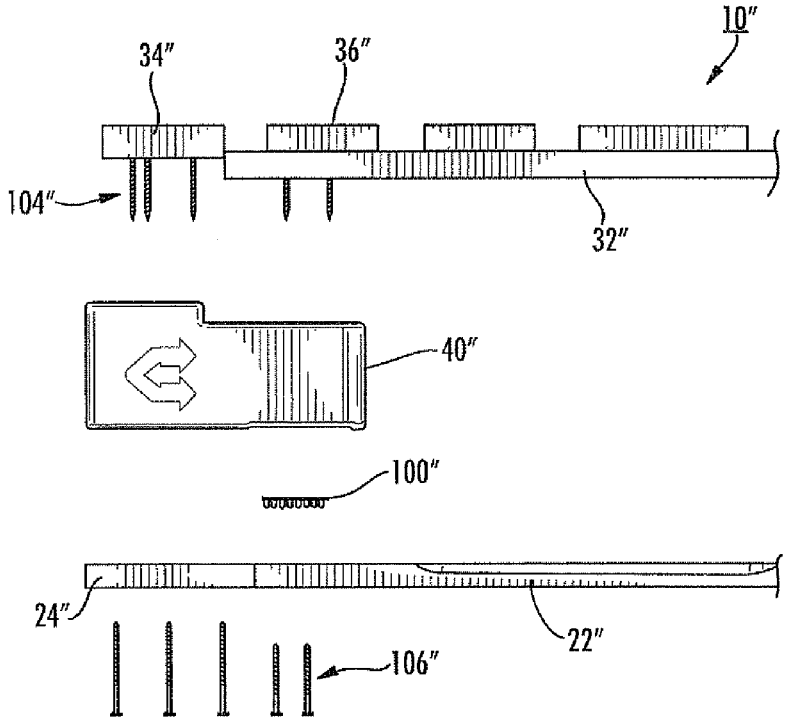
FIG. 10 is an exploded side view of the pallet shown in FIG. 9 with the strength plate.
Figure 11:
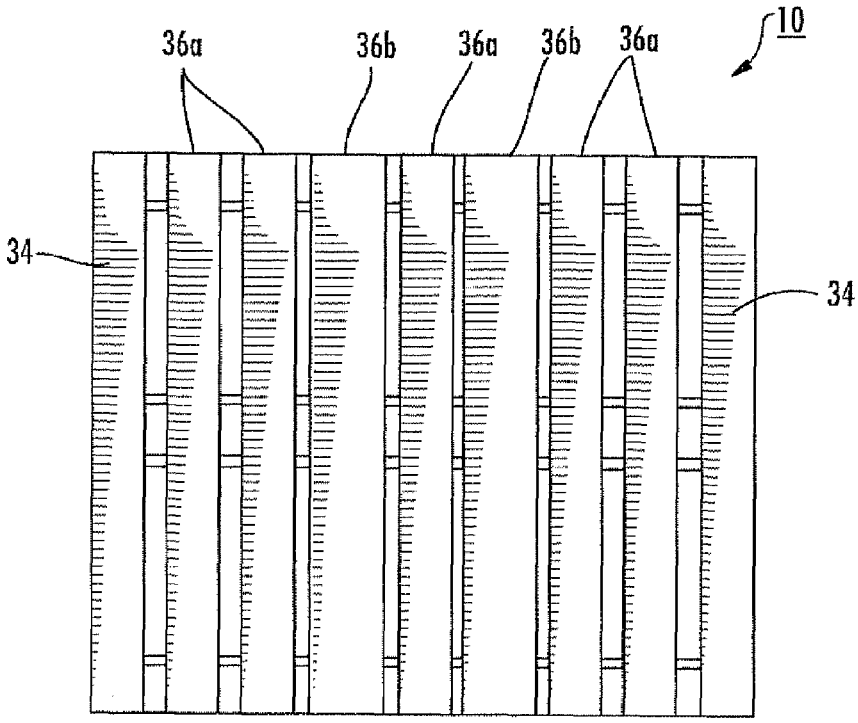
FIG. 11 is a top view of a pallet illustrating size and placement of the end deck boards and intermediate deck boards in the cargo layer in accordance with the present invention.
Figure 12:
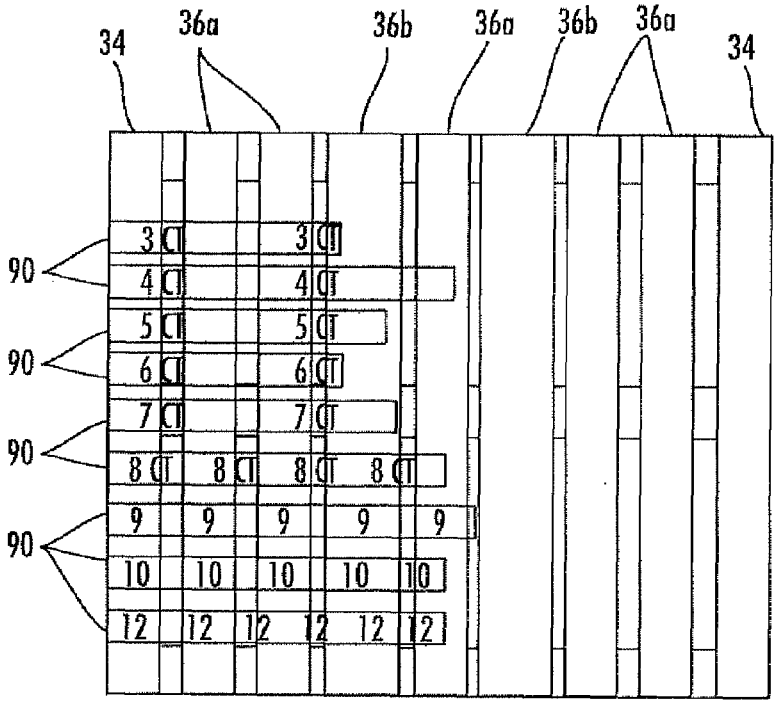
FIG. 12 is a top view of the pallet shown in FIG. 11 illustrating support of case corners for a variety of common case sizes.

Referring now to FIGS. 9 and 10, strength plates 100" may be used to further increase the resiliency of the pallet 10" with the single stepped support blocks 40". The strength plates 100" are coupled to the ends of the connector boards 22" in the base layer 20". The strength plates 100" may also be referred to as nail plates, and are particularly useful for distributing impact forces in the ends of the connector boards 22" in the base layer of the pallet 10".

Each end of a connector board 22" in the base layer 20" receives a strength plate 100". For the illustrated pallet 10", each connector board 22" has two strength plates 100" for a total of four strength plates per pallet. The illustrated strength plate 100" is made out of a metal sheet having a thickness of a few millimeters, for example. Flanges have been punched in the metal sheet so that they form projections 102" extending outwards from a lower surface of the strength plate 100". The illustrated upper surface of the strength plate is devoid of any projections. Nonetheless, projections may also extend from the upper surface of the strength plate in other embodiments.

Each strength plate 100" typically has a width that is substantially equal to a width of a respective end of the connector boards 22" in the base layer 20". The width of the strength plates 100" may be less than the width of the respective ends of the connector boards 22" as long as the fasteners 106" used to coupled the end of the connector board 22" to the lower surface of the support block 40" pass though the strength plate 100". This is also true for the length of the strength plates 100".

A first plurality of fasteners 104" is used for coupling the ends of the end deck boards 34" and the ends of the connector boards 32" in the cargo layer 20" to an upper surface of the support blocks 40". The illustrated upper surface of the supports blocks 40" is stepped. However, in other embodiments, the upper surface of the support blocks may be coplanar as is the lower surface of the illustrated support block 40". Although not shown, strength plates 100" may also be used for the connector boards 32" in the cargo layer 30".

Similarly, a second plurality of fasteners 106" is used for coupling the ends of the end deck boards 24" including the corresponding strength plates 100", and the ends of the connector boards 22" in the base layer 20" to a lower surface of the support blocks 40". The lower surface of the support blocks 40" includes first and second areas that are coplanar.

The ends of the connector boards 22" and the corresponding strength plates 100" are coupled to the first area of the lower surface, and the ends of the end deck boards 24" are coupled to the second area of the lower surface. The illustrated fasteners 104", 106" are nails, and easily penetrate through the strength plates 100". Other types of fasteners may be used, such as wood screws, for example.

When the end deck boards 24" in the base layer of the pallet 10" receive an impact force, such as from material handling equipment, the impact force is transmitted from the end deck boards 24" to the second fastening devices 106" in the ends of the connector boards 22". Without the strength plates 100", the impact force is focused on the ends of the connector boards, which in turn dissipates the impact to the second fasteners 106". As is typically the case, the ends of the connector boards 22" are the weak link in the pallet 10" and start to separate when the impact force is sufficiently large. As the ends of the connectors boards 22" separate, the crack extends down the length of the board. This eventually causes wood to separate from the pallet, which causes the pallet to fail. The strength plates 100" advantageously prevent this from happening by strengthening the ends of the connector boards 22" in the base layer. The transferred impact force is now distributed around the strength plates 100".

Yet another aspect of the invention is directed to optimizing size and placement of the end deck boards 34 and the intermediate deck boards 36 for the cargo layer 30 of the pallet 10. Positioning and size of the deck boards 34, 36 in the cargo layer 30 provide a high percentage of coverage to support a broad range of products that may rest on the cargo layer. These products are typically packaged in cargo cases, for example.

In accordance with optimizing the cargo layer 30 of the pallet 10, the number and size of the intermediate deck boards 36 are to be minimized while achieving full corner support for common cargo case sizes. Referring now to FIGS. 9 and 10, two or more different size intermediate deck boards 36*a*, 36*b* and a specific pattern are used to achieve full support of cargo case corners for the most common cargo case sizes of 16", 12", 8" and 6". The cargo cases having different sizes are represented by reference 90.

Intermediate deck boards 36*a* are within a range of about 3 to 4 inches wide, whereas intermediate deck boards 36*b* are within a range of about 5 to 6 inches wide. The end deck boards 34 are also within a range of about 3 to 4 inches wide.

As illustrated in the figures the width of the end deck boards 34 is 4 inches, the width of the intermediate deck boards 36*a* is 3.5 inches, and the width of the intermediate deck boards 36*b* is 5.5 inches. Alternatively, the end deck boards 34 may be the same width as the intermediate deck boards 36*a*, or vice-versa.

The illustrated pattern entails two 3.5 inch intermediate top deck boards 36*a*, followed by a 5.5 inch intermediate top deck board 36*b*, followed by a 3.5 inch intermediate top deck board, followed by another 5.5 inch intermediate top deck board, and then followed by two 3.5 inch intermediate top deck boards 36*a*.

The overall pattern of the intermediate top deck boards 36*a*, 36*b* with the end deck boards 34 define an outer exposed surface of the cargo layer 30 of overall dimensions 40 inches by 48 inches. The intermediate deck boards 36*a*, 36*b* are not limited to use with the illustrated support blocks 40. In other words, the optimized top deck pattern is applicable to pallets using conventional support blocks. Moreover, the optimized top deck pattern is also applicable to any type pallet design having a cargo layer.

Many modifications and other embodiments of the invention will come to the mind of one skilled in the art having the benefit of the teachings presented in the foregoing descriptions and the associated drawings. For instance, the step block design is applicable to a one-piece molded top deck and a one-piece molded bottom deck with deck boards that are serviceable. Therefore, it is understood that the invention is not to be limited to the specific embodiments disclosed, and that modifications and embodiments are intended to be included as readily appreciated by those skilled in the art.

That which is claimed:

1. A pallet comprising:

a cargo layer comprising a pair of spaced apart end deck boards, and a pair of spaced apart connector boards orthogonal to said pair of spaced apart end deck boards, each connector board and each end deck board having respective ends;

a base layer comprising a pair of spaced apart end deck boards, and a pair of spaced apart connector boards orthogonal to said pair of spaced apart end deck boards, each connector board and each end deck board having respective ends;

a strength plate coupled to each respective end of said connector boards in said base layer;

a plurality of spaced apart support blocks between said base and cargo layers and forming a gap therebetween for receiving a lifting member, each support block comprising a stepped top surface including a first level receiving a respective end of one of said deck boards in said cargo layer, and a second level receiving a respective end of one of said connector boards in said cargo layer, with the connector board adjacent to and non-overlapping with said end deck board;

a first plurality of fasteners coupling the respective ends of said deck boards in said cargo layer to the first level of said support blocks, and coupling the respective ends of said connector boards in said cargo layer to the second level of said support blocks; and a second plurality of fasteners coupling said base layer to a lower surface of said plurality of support blocks, with the ends of said connector boards and said corresponding strength plates coupled to a first area of the lower surface of said plurality of support blocks, and with the ends of said end deck boards coupled to a second area of the lower surface of said plurality of support blocks.

2. A pallet according to claim 1 wherein each strength plate comprises a plurality of projections extending therefrom and penetrating into a respective end of said connector boards in said base layer.

3. A pallet according to claim 2 wherein each strength plate includes a lower surface from which said plurality of projections extend therefrom, and an upper surface that is devoid of any projections extending therefrom.

4. A pallet according to claim 1 wherein each strength plate has a width that is substantially equal to a width of a respective end of said connector boards in said base layer.

5. A pallet according to claim 1 wherein the first and second areas of the lower surface of said plurality of support blocks are coplanar.

6. A pallet according to claim 1 wherein at least a portion of said second plurality of fasteners extend through the ends of said connector boards and said corresponding strength plates, and into the first area of the lower surface of said plurality of support blocks.

7. A pallet according to claim 1 wherein the stepped topped surface of each support block is configured so that the first level is above the second level with a transition wall defined therebetween; and wherein an outer exposed end of each connector board is adjacent the transition wall in said support block coupled thereto.

8. A pallet according to claim 1 wherein the stepped topped surface of each support block is configured so that the first level is below the second level with a transition wall defined therebetween; and wherein one side of each end deck board is adjacent the transition wall in said support blocks coupled thereto.

9. A pallet according to claim 1 wherein said cargo layer further comprises at least one intermediate deck board coupled to said pair of connector boards, and said at least one intermediate deck board substantially parallel to said pair of end deck boards.

10. A pallet according to claim 9 wherein an outer exposed top surface of said at least one intermediate deck board is coplanar with outer exposed top surfaces of said pair of end deck boards.

11. A pallet according to claim 1 further comprising a plurality of intermediate support blocks coupled between said base and cargo layers.

12. A pallet comprising:

a cargo layer comprising a pair of spaced apart end deck boards, and a pair of spaced apart connector boards orthogonal to said pair of spaced apart end deck boards, each connector board and each end deck board having respective ends;

a base layer comprising a pair of spaced apart end deck boards, and a pair of spaced apart connector boards orthogonal to said pair of spaced apart end deck boards, each connector board and each end deck board having respective ends;

a strength plate coupled to each respective end of said connector boards in said base layer;

a plurality of spaced apart support blocks between said base and cargo layers and forming a gap therebetween for receiving a lifting member, each support block comprising a stepped top surface and a coplanar lower surface, with the stepped top surface including a first level receiving a respective end of one of said deck boards in said cargo layer, and a second level receiving a respective end of one of said connector boards in said cargo layer, with the connector board adjacent to and non-overlapping with said end deck board;

a first plurality of fasteners coupling the respective ends of said deck boards in said cargo layer to the first level of said support blocks, and coupling the respective ends of said connector boards in said cargo layer to the second level of said support blocks; and a second plurality of fasteners coupling said base layer to the coplanar lower surface of said plurality of support blocks, with the ends of said connector boards and said corresponding strength plates coupled to a first area of the coplanar lower surface of said plurality of support blocks, and with the ends of said end deck boards coupled to a second area of the coplanar lower surface of said plurality of support blocks.

13. A pallet according to claim 12 wherein each strength plate comprises a plurality of projections extending therefrom and penetrating into a respective end of said connector boards in said base layer.

14. A pallet according to claim 13 wherein each strength plate includes a lower surface from which said plurality of projections extend therefrom, and an upper surface that is devoid of any projections extending therefrom.

15. A pallet according to claim 12 wherein each strength plate has a width that is substantially equal to a width of a respective end of said connector boards in said base layer.

16. A pallet according to claim 12 wherein at least a portion of said second plurality of fasteners extend through the ends of said connector boards and said corresponding strength plates, and into the first area of the lower surface of said plurality of support blocks.

17. A pallet according to claim 12 wherein the stepped upper surface of each support block is configured so that the first level is above the second level with a transition wall defined therebetween; and wherein an outer exposed end of each connector board is adjacent the transition wall in said support block coupled thereto.

18. A pallet according to claim 12 wherein the stepped upper surface of each support block is configured so that the first level is below the second level with a transition wall defined therebetween; and wherein one side of each end deck board is adjacent the transition wall in said support blocks coupled thereto.

19. A pallet according to claim 12 wherein said cargo layer further comprises at least one intermediate deck board coupled to said pair of connector boards, and said at least one intermediate deck board substantially parallel to said pair of end deck boards; and wherein an outer exposed top surface of said at least one intermediate deck board is coplanar with outer exposed top surfaces of said pair of end deck boards.

20. A method for making a pallet comprising:

providing a cargo layer comprising a pair of spaced apart end deck boards, and a pair of spaced apart connector boards orthogonal to the pair of spaced apart end deck boards, each connector board and each end deck board having respective ends;

providing a base layer comprising a pair of spaced apart end deck boards, and a pair of spaced apart connector boards orthogonal to the pair of spaced apart end deck boards, each connector board and each end deck board having respective ends;

coupling a strength plate to each respective end of the connector boards in the base layer;

providing a plurality of spaced apart support blocks between the base and cargo layers and forming a gap therebetween for receiving a lifting member, each support block comprising a stepped top surface including a first level receiving a respective end of one of the deck boards in the cargo layer, and a second level receiving a respective end of one of the connector boards in the cargo layer, with the connector board adjacent to and non-overlapping with the end deck board using a first plurality of fasteners coupling the respective ends of the deck boards in the cargo layer to the first level of the plurality of support blocks, and coupling the respective ends of the connector boards in the cargo layer to the second level for the plurality of support blocks; and using a second plurality of fasteners coupling the base layer to a lower surface of the plurality of support blocks, with the ends of the connector boards and the corresponding strength plates coupled to a first area of the lower surface of the plurality of support blocks, and with the ends of the end deck boards coupled to a second area of the lower surface of the plurality of support blocks.

21. A method according to claim 20 wherein each strength plate comprises a plurality of projections extending therefrom and penetrating into a respective end of the connector boards in the base layer.

22. A method according to claim 21 wherein each strength plate includes a lower surface from which the plurality of projections extend therefrom, and an upper surface that is devoid of any projections extending therefrom.

23. A method according to claim 20 wherein each strength plate has a width that is substantially equal to a width of a respective end of the connector boards in said base layer.

24. A method according to claim 20 wherein at least a portion of the second plurality of fasteners extend through the ends of the connector boards and the corresponding strength plates, and into the first area of the lower surface of said plurality of support blocks.

* * * * *

UNITED STATES PATENT AND TRADEMARK OFFICE

CERTIFICATE OF CORRECTION

PATENT NO. : 7,516,705 B2
APPLICATION NO. : 11/839825
DATED : April 14, 2009
INVENTOR(S) : Kristen Hedstrom It is certified that error appears in the above-identified patent and that said Letters Patent is hereby corrected as shown below:

Column 3, Line 4, Delete: "locks"
Insert: -- blocks --

Signed and Sealed this

Second Day of June, 2009

JOHN DOLL
*Acting Director of the United States Patent and Trademark Office*